United States Patent [19]

Rhinefrank et al.

[11] 4,218,983

[45] Aug. 26, 1980

[54] SINGLE-CAM ACTUATED DRUM SEAMING MECHANISM

[75] Inventors: Robert A. Rhinefrank, Stockton; William H. Sunday, Lodi, both of Calif.

[73] Assignee: Carando Machine Works, Stockton, Calif.

[21] Appl. No.: 21,027

[22] Filed: Mar. 16, 1979

[51] Int. Cl.[3] ..... B21D 39/02

[52] U.S. Cl. ..... 113/1 E; 113/1 G; 113/24 E; 113/120 Y

[58] Field of Search ..... 113/1 E, 1 F, 1 G, 120 Y, 113/24 R, 24 A, 24 E, 24 EA, 24 F, 24 EB, , 24 D

[56] References Cited

U.S. PATENT DOCUMENTS

| | | | |
|---|---|---|---|
| 785,347 | 3/1905 | Beyer | 113/20 A |
| 800,425 | 9/1905 | Beyer | 113/21 |
| 804,642 | 11/1905 | Walsh | 113/28 |
| 821,605 | 5/1906 | Brenzinger | 113/21 |
| 1,826,506 | 10/1931 | Cotes | 113/20 B |
| 1,842,447 | 1/1932 | Dister | 113/28 |
| 2,101,291 | 12/1937 | Price | 113/30 |
| 2,104,224 | 1/1938 | Fisher | 113/30 |
| 2,312,102 | 2/1943 | Krueger | 113/24 EA |
| 2,382,469 | 8/1945 | Diezel | 113/24 EA |
| 3,672,317 | 6/1972 | Halling | 113/1 E |
| 4,004,529 | 1/1977 | Grotnes | 113/1 E |

*Primary Examiner*—Francis S. Husar
*Assistant Examiner*—Gene P. Crosby
*Attorney, Agent, or Firm*—Roger B. Webster

[57] ABSTRACT

A seaming mechanism for a machine of the type employed to secure a metallic head on a metallic drum by deforming and folding together adjacent, initially lapped, peripheral portions of the head and drum end; such mechanism embodying a pair of seaming rolls positioned for sequential movement into working engagement with such peripheral portions of the head and drum end, and corresponding seaming roll supporting arm units—actuated from a single, driven cam—operative to impart such sequential movement to said seaming rolls.

18 Claims, 7 Drawing Figures

1
2
3
4
5
6
7
8
9
10
11
12
13
14
15
16
17
18
19
20
21
22
23
24
25
26
27
-2-
-2-

-5-
2
20
40
35
34
33
34
32
32
35
40
38
38
-3-
-3-
28
30
28
41
41
-4-
-4-
43
25
16
-5-
16
13
43
25a
15
25
26
11
11
1
8

SINGLE-CAM ACTUATED DRUM SEAMING MECHANISM

BACKGROUND OF THE INVENTION

1. FIELD OF THE INVENTION

The present invention pertains in general to a machine for securing a metal head on, and in closing relation to, an end of a metal drum by an operation known as "seaming", and which attaches and seals the head to the drum end by deformation and folding together of adjacent, initially lapped, peripheral portions thereof. Machines of this type are known in sundry embodiments, and which include a seaming mechanism embodying a pair of seaming rolls positioned for sequential movement into working position, and which movement is produced by cam-actuation of corresponding seaming roll supporting arm units. In certain instances, there is a separate cam employed for each arm unit, while other adaptations have employed a single cam to actuate all the seaming roll supporting arm units. In both of the above adaptations, problems have been encountered either because of complexity and cost, structural faults, or inefficient or impractical performance. The present invention was conceived in a successful effort to produce a single-cam actuated seaming mechanism which avoids the problems, or undesirable characteristics, of the prior adaptations.

2. THE PRIOR ART

U.S. Pat. Nos. 785,347; 800,425; 804,642; 821,605; 1,826,506; 1,842,447; 2,101,291; 2,104,224; 2,382,469; 3,672,317 and 4,004,529 represent the most relevant prior art known to applicants.

The above prior art—considered singly or together—does not anticipate, nor suggest as obvious, the particular structure and function of the herein-claimed seaming mechanism, and applicants have no knowledge of any prior art disclosing such particular structure and its function.

SUMMARY OF THE INVENTION

The present invention provides, as a major object, an improved seaming mechanism, in a machine and for the purpose described, which includes a novel, single-cam actuated array of seaming roll supporting and positioning arm units; such single-cam actuated arm units, in part disposed in intersecting relation, being arranged in a simple, compact, economically manufactured, readily assembled, and functionally efficient structural combination requiring a minimum of maintenance and servicing.

The present invention provides, as another important object, a seaming mechanism, as above, wherein each of the single-cam actuated arm units (of which there are two in the present embodiment) are individually adjustable whereby to selectively pre-position each seaming roll as working conditions (i.e., drum diameter, or otherwise) may require.

The present invention provides, an another important object, a seaming mechanism, as above, wherein each single-cam actuated arm unit, while capable of withstanding relatively heavy loading, does include "shear pin" protection against very excessive, accidental loads.

The present invention provides, as a further object, a seaming mechanism which is designed for ease and economy of manufacture.

The present invention provides, as a still further object, a practical, reliable, and durable seaming mechanism, and one which is exceedingly effective for the purpose for which it is designed.

DESCRIPTION OF THE PREFERRED EMBODIMENT

Figure 1:
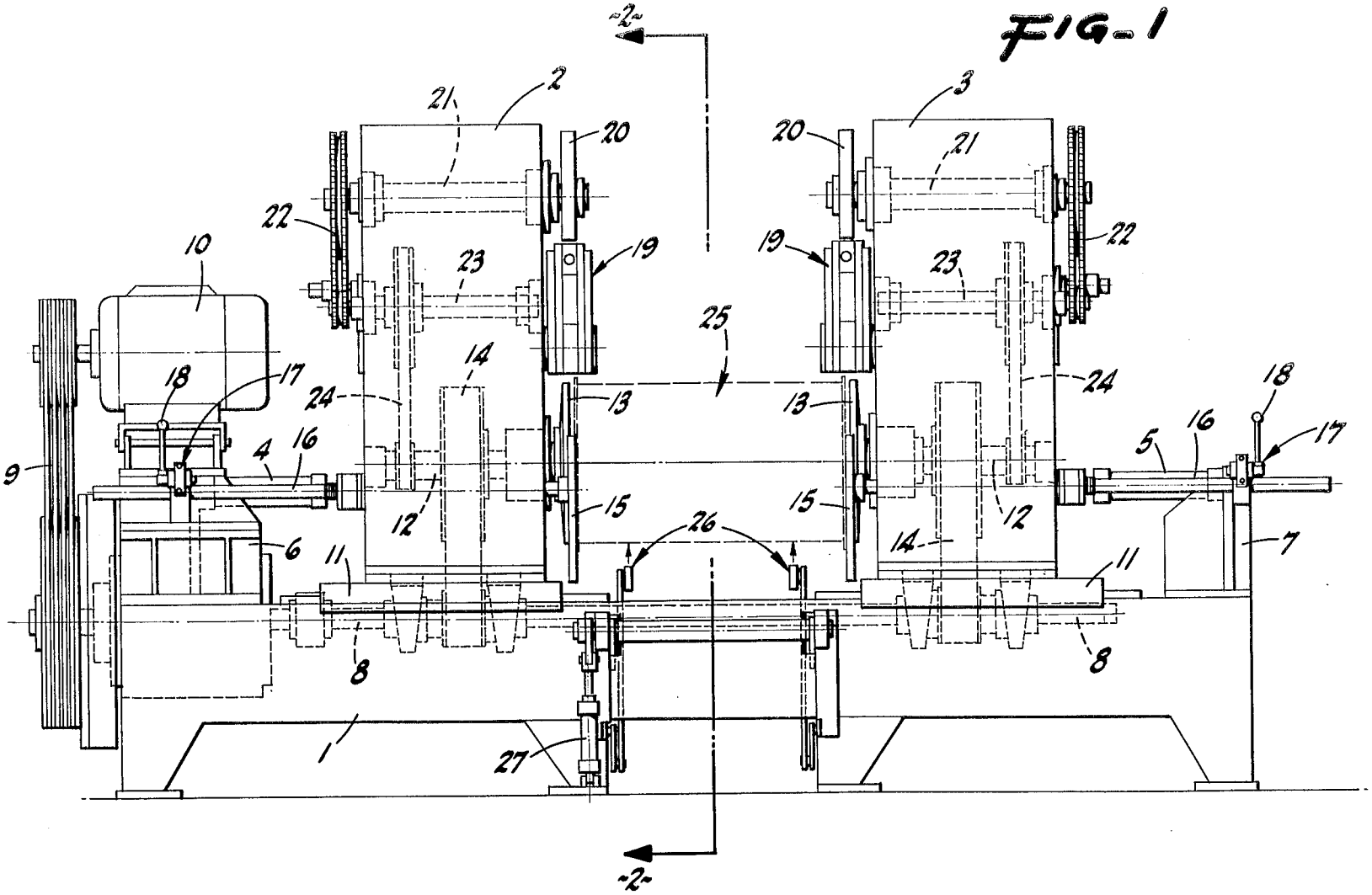
FIG. 1 is a side elevation of a drum and head seaming machine embodying the seaming mechanism of the present invention.

Referring now more particularly to the drawings and to the characters of reference marked thereon, the present invention is embodied in a drum and head seaming machine which includes a longitudinal, floor-supported bed 1 having a pair of hollow columns, indicated at 2 and 3, respectively, slidably mounted on, and upstanding from, the bed 1 in spaced relation. The columns 2 and 3 are simultaneously advanced toward, or retracted from, each other—through a limited range of movement—by double-acting power cylinders, indicated at 4 and 5, respectively, connected between tailstocks 6 and 7 fixed on the bed 1 adjacent its ends.

A main drive shaft 8 is journaled in and extends in the bed 1 below the columns 2 and 3; such drive shaft 8 being driven by an endless belt and pulley unit 9 which spans between one end of such shaft and an electric motor 10 mounted above the tailstock 6.

The columns 2 and 3 and the parts associated therewith are substantially identical except that they face in opposition (i.e., toward each other), and hence a description of one such column and associated parts will suffice for both.

A column (2—3) is of heavy-duty, hollow construction and at the lower end includes a slide 11 mounted on the bed 1; there being a longitudinal countershaft 12 journaled in the column and projecting from the face thereof, and the projecting end being fitted with a circular, radial, mandrel-forming chuck 13. An endless drive 14 spans between the driven main shaft 8 and the countershaft 12; such drive 14 having suitable relatively slidable connection with shaft 8 to permit of limited sliding of the column on the bed.

An arcuate stripper 15 surrounds the lower portion of the chuck 13, and such stripper is carried on the adjacent ends of stripper rods 16 which pass through the column and thence extend to connection with the related tailstock (6–7) by means of a releasable clamping unit 17 which includes a release lever 18. The particular structural combination of the stripper 15, stripper rods 16 (as associated with the column), and the clamping unit 17 is detailed in co-pending U.S. patent application Ser. No. 26,363, filed Apr. 2, 1979.

A drum seaming mechanism, indicated generally at 19 and which embodies the present invention, is mounted on the face of the column in substantially radial alinement with, and above, the chuck 13; such seaming mechanism—hereinafter described in detail—including a rotary cam 20 carried on the projecting end of a longitudinal shaft 21 driven at the back of the column by an endless driving and timing chain unit 22 actuated from another longitudinal shaft 23 in the column, and which other shaft 23 is driven from the counter-shaft 12 by an endless drive 24.

The above-described power train—wherein the shafts are all parallel—produces rotation of the chuck 13 and simultaneous timed rotation of the rotary cam 20.

In use of the above-described machine, a drum 25 (with a head **25*a* in each end but un-seamed) is elevated by a roller-type cradle unit 26—actuated by a power cylinder 27—to a position in axial alinement with, but clear of, the chucks 13. Thereafter, with slight approaching movement of the columns 2 and 3 and as caused by the power cylinders 4 and 5, the chucks correspondingly move and each matchingly engages in the concavity of the related drum head—the chucks then supporting the drum preparatory to the simultaneous seaming operations, by the seaming mechanisms 19**, as hereinafter described.

After the seaming operations, the columns 2 and 3—together with the chucks—retract, and the stationary strippers free the drum and seamed-in head from the chucks and for removal from the machine.

Each drum seaming mechanism, as indicated generally at 19, is constructed, and functions in response to timed rotation of the included cam 20, as follows:

On the face of the column (2–3), and below the cam 20, there is disposed a pair of adjacent but transversely spaced, L-shaped arms 28 which are in opposed facing relation; such arms being hereinafter identified as the "primary arms". Such primary arms 28 are pivotally mounted intermediate their ends on pintles 29 which parallel the axis of the cam. As so mounted, each primary arm 28 is fitted at its lower and inner end with a seaming roll 30 journaled so that the bottom peripheral portion of the roll is disposed below the arm; the two rolls 30—which are substantially conventional—being in alinement, radially, with each other and the chuck 13, and occupy positions closely adjacent each other above the chuck.

As shown, the primary arms 28 are of double-sided construction, with the seaming rolls 30 disposed in journaled relation between the sides of such arms; the journal pins being indicated at 31.

Follower arms 32, likewise of double-sided construction, are journaled on the pintles 29 between the sides of the primary arms 28; such follower arms 32, which are of generally dog-leg form as shown, upstand above the pintles 29 and include upwardly and inwardly inclined arm portions 33 which intersect, above the rolls 30, in relatively movable relation—one such arm portion 33 passing through the other between the sides thereof.

At their upper or free ends, the portions 33 of follower arms 32 are each fitted with a roller 34 which rides, at all times, the periphery of the rotary cam 20.

Each primary arm 28 and the corresponding follower arm 32 are adjustably connected together—as an adjustable articulated arm assembly—as follows:

In spaced relation above the related pintle 29, the follower arm 32 is formed on each side with an elongated slot 35 which extends generally concentric to such pintle, and the upper end of the primary arm 28 carries—between the sides thereof—a cylindrical roller 36 which extends into the slots 35; said roller 36 having end trunnions 37 journaled in the sides of said upper end of the primary arm 28. While essentially serving to support the cylindrical roller 36, the trunnions also serve as shear pins.

An adjustment screw 38 (adapted for crank rotation) is threaded through a member 39 fixed in the follower arm 32 immediately beyond the outer end of the slots 35, and the inner end of such adjustment screw 38 bears radially and directly on the cylindrical roller 36; the adjustment screw 38 normally being held against rotation by a hand-manipulated, releasable set screw 40. With the above arrangement, the roller and screw assembly maintain the primary arm and follower arm in rigid array in the direction of the working or cam load as will be understood. The cylindrical roller 36 and the adjustment screw—of each arm assembly—are maintained in constant engagement in the following manner:

To the rear of the corresponding seaming roll 14, the face of the column is formed with a vertically elongated slot 41, and the related seaming roll journal pin 31 includes an integral, rearwardly projecting boss 42 which extends through the slot 41. Within the column, and inwardly of the face thereof, an elongated compression spring unit 43 is connected, under load, between the boss 42 and the bottom of the column. Each such compression spring unit 43—being under load and acting through the associated parts—yieldably urges the related seaming roll 30 upwardly, maintains the corresponding cylindrical roller 36 in engagement with the adjustment screw 38, and maintains constant riding contact of the corresponding roller 34 on the rotary cam 20.

By the simple expedient of rotary adjustment of screw 38, as by a crank (not shown) applied to the free end of such screw, the related primary arm can be adjusted in a direction to raise or lower (within fine limits) the seaming roll and as working conditions may require.

Figure 2:
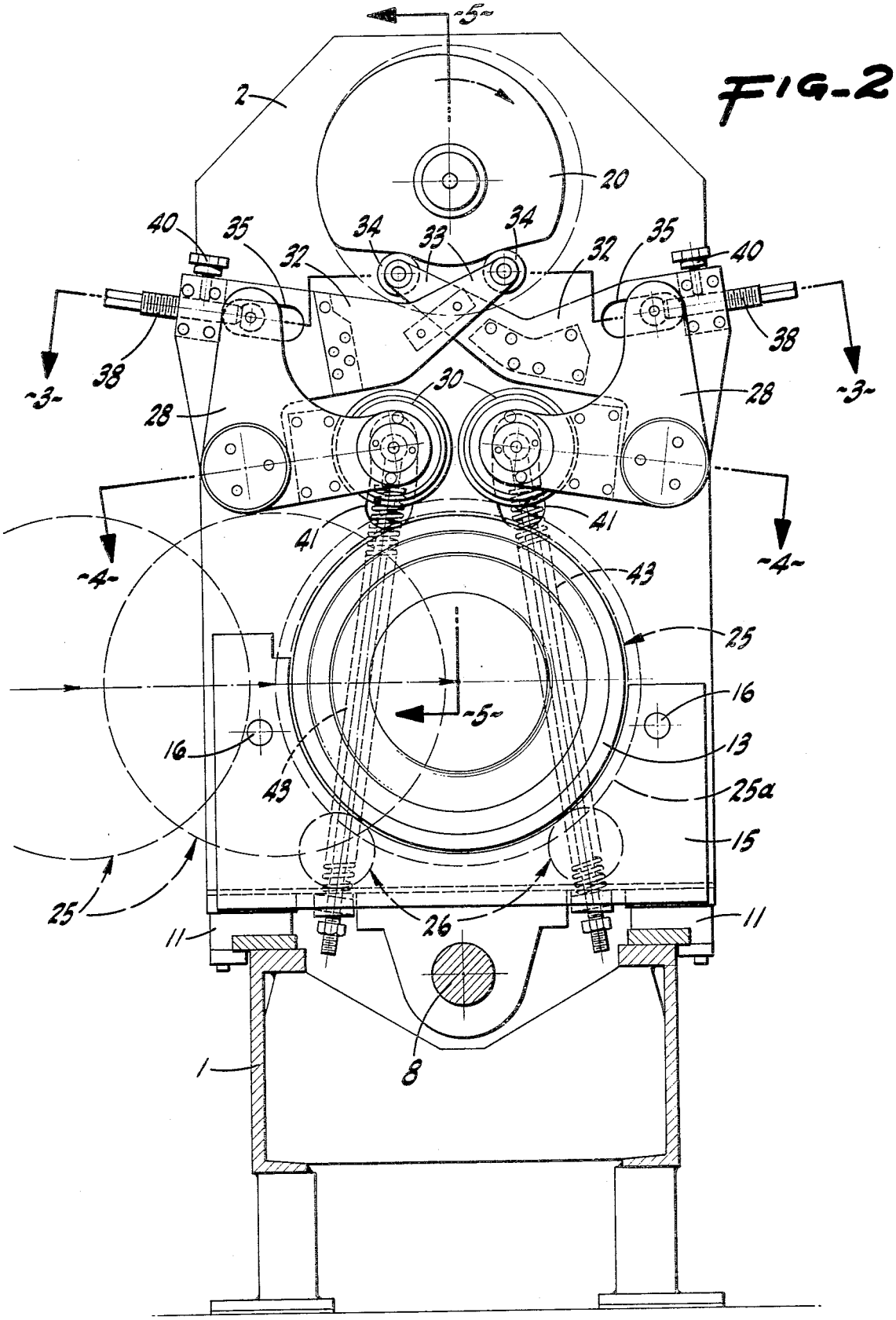
FIG. 2 is an enlarged transverse elevation taken substantially on line 2—2 of FIG. 1; the view, in particular, showing one of the opposed seaming mechanisms which the machine includes, and with such mechanism disposed with the seaming rolls in raised position as at the start of each cycle of operation.
Figure 3:
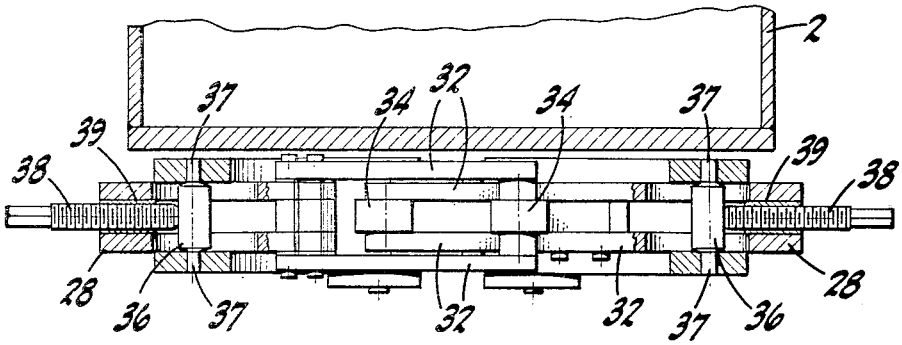
FIG. 3 is a fragmentary sectional plan view taken substantially on line 3—3 of FIG. 2.
Figure 4:
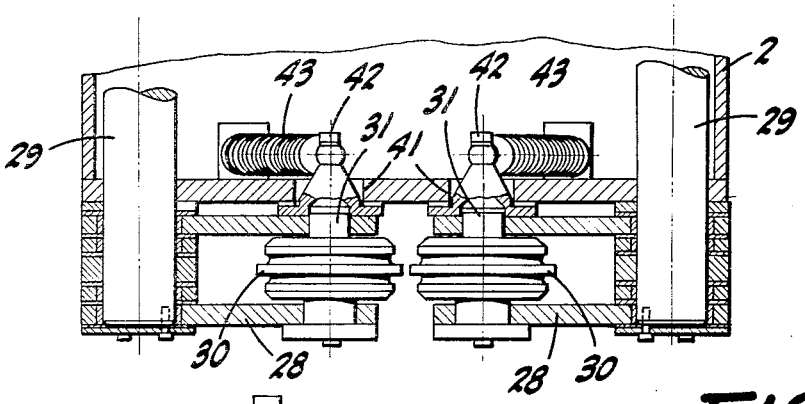
FIG. 4 is a fragmentary sectional plan view taken substantially on line 4—4 of FIG. 2.

The cam edge of the rotary cam 20 is generated so that prior to the initiation of each seaming operation, the follower rollers 34 stand (see FIG. 2) in a recessed or relieved portion of the cam edge, and at which time—under the influence of compression spring units 43—the seaming rolls 30 are in a raised, non-working position.

OPERATION

When the machine is in use, a drum 25 is elevated—by cradle unit 26—to a position in axial alinement between the chucks 13; the columns (2–3) and said chucks then being in a retracted or starting mode. Thereafter, the power cylinders (4–5) advance the columns (2–3) toward each other and until the chucks engage in the heads **25*a* pre-positioned in the drum 25**.

Nextly, through the medium of the described power train and under suitable control, the chucks are simultaneously rotated 360°, and the rotary cams 20 are likewise simultaneously rotated to the same extent.

Figure 6:
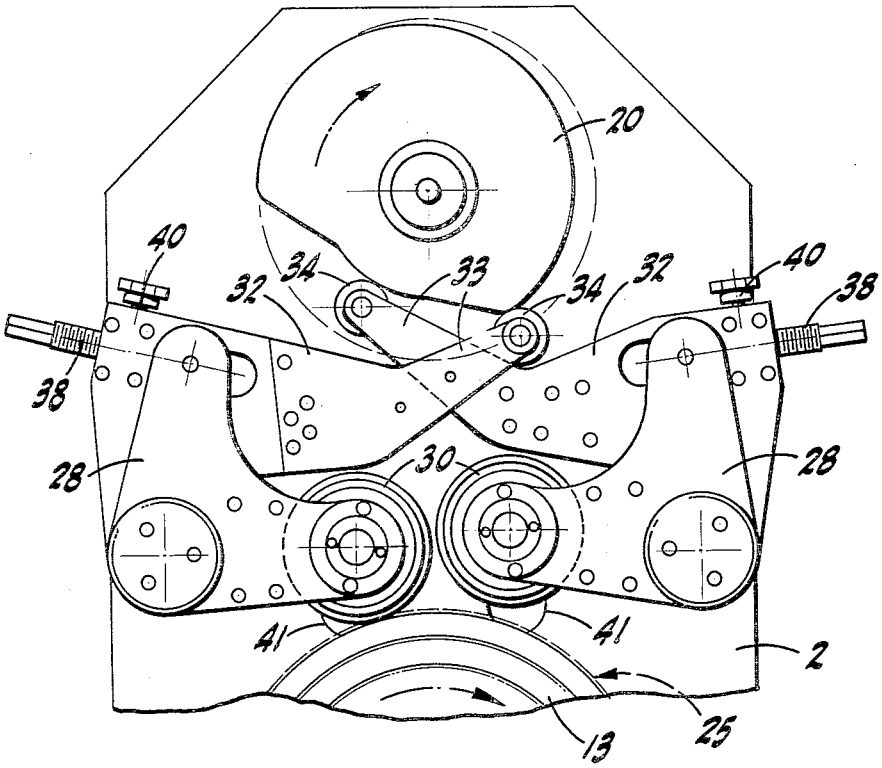
FIG. 6 is a fragmentary elevation similar to FIG. 2, but shows the lead seaming roll in lowered working position.
Figure 7:
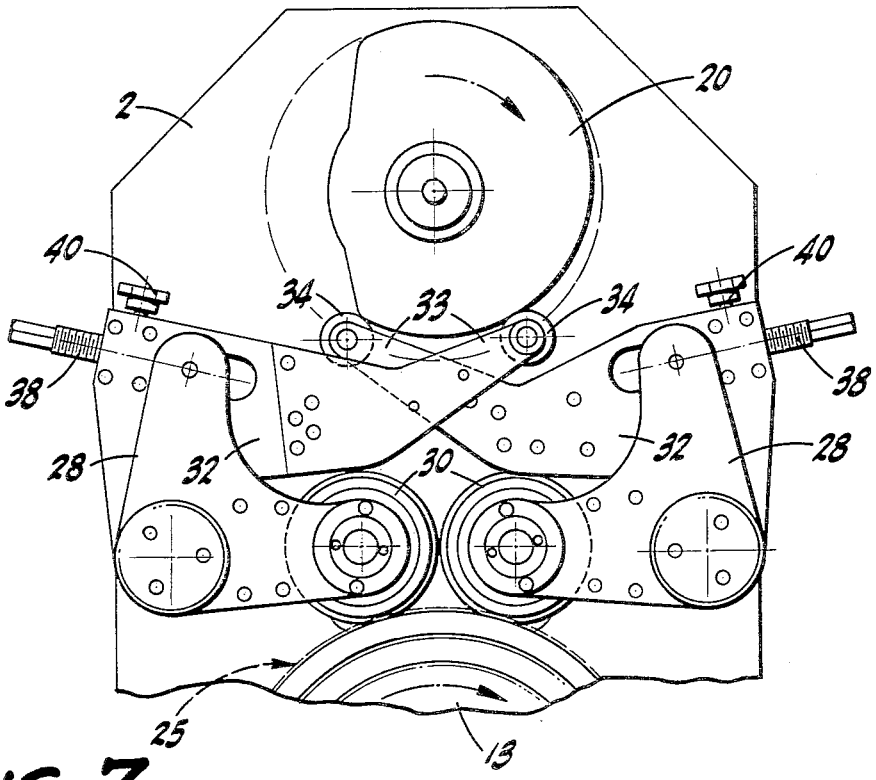
FIG. 7 is a like view, but shows both the lead and trailing seaming rolls in lowered, working position.

Upon such rotation of the rotary cam 20 of each drum seaming mechanism 19, firstly the left-hand or lead seaming roll 30 is forcefully lowered—by the cam 20 acting through the corresponding arm unit—from raised starting position (FIG. 2) to lowered working position (FIG. 6) in which said left-hand seaming roll imparts the initial seaming deformation to the adjacent and lapping peripheral portions of the drum 25 and drum head 25*a*. This is followed by the right-hand or trailing seaming roll 30 being forcefully lowered—by the cam 20 acting through the corresponding arm unit—from raised starting position (FIG. 2) to lowered working position (FIG. 7) in which said right-hand seaming roll imparts the final seaming deformation to such adjacent and lapping peripheral portions of the drum and drum head. The seam 44, as formed, is conventional, and which seals each drum head 25*a* to the corresponding end of the drum.

Figure 5:
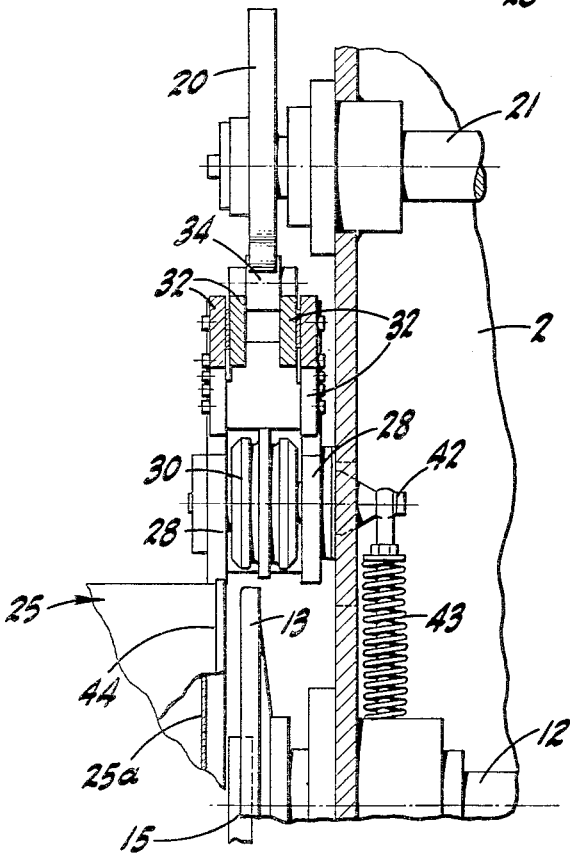
FIG. 5 is a fragmentary, longitudinal sectional elevation taken substantially on line 5—5 of FIG. 2.

Upon completion of each seaming operation or cycle, the seaming mechanisms each rest in position for starting the next cycle, and the columns (2–3) are then retracted (see FIG. 5) which pulls the chucks 13 away from the drum heads 25*a;* the strippers 15, which remain stationary, assuring that the chucks pull free of said drum heads 25*a* and so that the drum 25 can be withdrawn, without obstruction, from the machine.

It will be recognized that, in the described drum seaming mechanism, the intersection of the portions 33 of follower arms 32 of each arm assembly permits not only of a compact structure, but also the effective actuation of the lead seaming roll 30 in advance of the trailing seaming roll.

Adjustment of the seaming rolls 30—up or down—for drum size, or to compensate for variance in thickness of the metal being seamed, is readily accomplished through the medium of the adjustment screws and which alter the working angle between the primary arms 28 and the follower arms 32.

From the foregoing description, it will be readily seen that there has been produced such a seaming mechanism as substantially fulfills the objects of the invention as set forth herein.

While this specification sets forth in detail the present and preferred construction of the seaming mechanism, still in practice such deviations from such detail may be resorted to as do not form a departure from the spirit of the invention as defined by the appended claims.

What is claimed is:

1. In a machine—for seaming a pre-positioned head in a drum—which includes a column, a circular chuck journaled on the column, the chuck being adapted for engagement with the head of an axially alined drum, and means to rotate the chuck and in turn the drum; a single-cam actuated, drum seaming mechanism mounted on the column and comprising a rotary cam journaled on the column in spaced relation above the chuck, the chuck and cam axes being parallel, means to rotate the cam, and a pair of spaced arm units pivotally mounted on the column between the chuck and the cam, each arm unit engaging at one end with the cam and being fitted at the other end with a seaming roll, the seaming rolls being swingable by the pivotally mounted arm units, upon their response to rotation of the cam, from a non-working position clear of the drum to a working, drum head seaming position.

2. A drum seaming mechanism, as in claim 1, in which the means to rotate the chuck and the means to rotate the rotary cam are interconnected to provide predetermined timed rotation of the chuck and cam.

3. A drum seaming mechanism, as in claim 1, in which the axes of the chuck, the cam, and the pivotally mounted arm units are horizontal and parallel; and the chuck, cam, and arm units occupy closely adjacent transverse vertical planes.

4. A drum seaming mechanism, as in claim 1, in which the cam is arranged to cause one seaming roll to be swung to working position in advance of the other seaming roll.

5. A drum seaming mechanism, as in claim 1, in which the arm units include primary arms which are of L-shaped and which are disposed in opposed facing relation, and follower arms mounted in connection with the primary arms and extending to adjacent the cam; the follower arms having follower elements thereon in cam engagement.

6. A drum seaming mechanism, as in claim 5, in which the primary arm and follower arm of each arm unit are pivotally mounted intermediate their ends on the same axis, and there being means connecting the primary arm and the follower arm against relative rotation in at least one direction.

7. A drum seaming mechanism, as in claim 6, in which said connecting means is adjustable to alter the angular relation between the primary arm and follower arm whereby to adjust the position of the seaming rolls relative to the chuck.

8. A drum seaming mechanism, as in claim 7, in which said connecting means comprises a member on the end of the primary arm opposite its seaming roll, and an adjustment screw threaded through an adjacent portion of the follower arm and bearing on such member; there being means releasably securing the adjustment screw against rotation.

9. A drum seaming mechanism, as in claim 7, in which the primary arm is double-sided with the follower arm pivoted between the sides thereof, and said connecting means comprising a roller spanning between and end-secured to the sides of the primary arm at the end opposite its seaming roll, the adjacent portion of the follower arm having an elongated slot through which the roller extends intermediate its ends, and an adjustment screw threaded in connection with the follower arm beyond the slot and bearing on the roller.

10. A drum seaming mechanism, as in claim 9, in which the roller includes end trunnions journaled in the sides of the primary arm and providing a shear pin factor.

11. A drum seaming mechanism, as in claim 1, including spring means associated with each arm unit and arranged to yieldably resist swinging of the corresponding seaming roll to said working position thereof, and to maintain engagement of said arm unit with the cam.

12. A drum seaming mechanism, as in claim 11, in which the spring means related to each arm unit comprises an elongated compression spring unit, the corresponding seaming roll having an axial pivotal boss projecting therefrom, and the elongated spring unit being connected at one end to the boss and thence extending radially therefrom to connection with the column.

13. In a machine—for seaming a pre-positioned head in a drum—which includes a column, a vertical, horizontal axis, circular chuck journaled on the column, the chuck being adapted for engagement with the head of a horizontal, axially alined drum, and means to rotate the chuck and in turn the drum; a single-cam actuated seaming mechanism mounted on the column above the chuck and comprising a vertical, horizontal axis, rotary cam journaled on the column in spaced relation above the chuck, the chuck and cam axes being parallel, means to rotate the cam in timed relation to the chuck, a pair of transversely spaced arm units pivotally mounted on the column between the chuck and the cam, the pivotal axes of the arm units being parallel to the axes of the chuck and cam, each arm unit engaging at one end with the cam and being fitted at the other end with a seaming roll, the seaming rolls being swingable by the pivotally mounted arm units, upon their response to rotation of the cam, from a non-working position above the drum to a lowered, drum head seaming position.

14. A drum seaming mechanism, as in claim 13, in which the arm units include primary arms of L-shape and which are disposed in opposed facing relation, the seaming rolls being mounted on the lower, inner ends of such L-shaped primary arms, and follower arms mounted in connection with the primary arms and extending therefrom at an upward and inward incline toward the cam, and cam follower elements on the upper ends of the follower arms.

15. A drum seaming mechanism, as in claim 14, in which upper portions of the follower arms intersect below said cam follower elements.

16. A drum seaming mechanism, as in claim 14, in which the primary arm and corresponding follower arm of each arm unit are pivotally mounted intermediate their ends on the same axis, and there being means, including an adjustment screw, connecting the primary arm and the follower arm against relative rotation in at least one direction.

17. A drum seaming mechanism, as in claim 16, including spring means between each arm unit and the column yieldably urging the arm units in a rotary direction to maintain said arm units in cam engagement.

18. A drum seaming mechanism, as in claim 17, in which the spring means related to each arm unit comprises an upstanding, elongated compression spring unit, the corresponding seaming roll having an axial pivotal boss projecting rearwardly therefrom, the elongated compression spring unit being connected at the upper end to the boss and thence depending therefrom to connection at the lower end with the column.

* * * * *